US007445362B2

(12) United States Patent
Compton et al.

(10) Patent No.: US 7,445,362 B2
(45) Date of Patent: Nov. 4, 2008

(54) PARKING GARAGE LUMINAIRE WITH INTERCHANGEABLE REFLECTOR MODULES

(75) Inventors: Wayne W. Compton, Chino Hills, CA (US); Thomas C. Lueken, Diamond Bar, CA (US)

(73) Assignee: Hubbell Incorporated, Orange, CT (US)

( * ) Notice: Subject to any disclaimer, the term of this patent is extended or adjusted under 35 U.S.C. 154(b) by 39 days.

(21) Appl. No.: 11/366,800

(22) Filed: Mar. 3, 2006

(65) Prior Publication Data

US 2007/0206384 A1 Sep. 6, 2007

(51) Int. Cl.
*F21V 7/00* (2006.01)

(52) U.S. Cl. ..... 362/346; 362/282; 362/147; 362/332

(58) Field of Classification Search ..... 362/147, 362/304, 306, 350, 365, 404, 406, 408, 282, 362/277, 346
See application file for complete search history.

(56) References Cited

U.S. PATENT DOCUMENTS 1,508,184 A 9/1924 Harrison
1,588,222 A 6/1926 D'Olier, Jr.
1,794,839 A * 3/1931 Dorey ..... 362/332
D107,877 S 1/1938 Levy
D124,167 S 12/1940 Arenberg
D169,972 S 7/1953 Glatthar et al.
3,562,513 A * 2/1971 Jaffe ..... 362/305
3,700,883 A 10/1972 Donohue et al.
D240,320 S 6/1976 Anderson
4,087,682 A 5/1978 Kolodziej
D254,215 S 2/1980 Yahraus et al.
4,231,080 A 10/1980 Compton
4,234,912 A * 11/1980 Barnes et al. ..... 362/145
4,338,655 A 7/1982 Gulliksen et al.
4,856,103 A 8/1989 Compton
D343,250 S 1/1994 Fouke et al.
D354,580 S 1/1995 Fouke et al.
D361,400 S 8/1995 Compton
5,486,989 A 1/1996 Compton
D377,841 S 2/1997 Vakil
D377,991 S 2/1997 Vakil
D402,075 S 12/1998 Hudak et al.
D402,382 S 12/1998 Pearce et al.
5,855,427 A 1/1999 Lassovsky
D406,674 S 3/1999 Zuege
6,036,338 A 3/2000 Gordin
D443,713 S 6/2001 Benensohn (Continued)

*Primary Examiner*—Ali Alavi
(74) *Attorney, Agent, or Firm*—Alfred N. Goodman; Mark S. Bicks

(57) ABSTRACT

A luminaire capable of selectively directing light from a lamp therein generally upwardly, downwardly, and outwardly, the combination comprising an electrical housing having a generally downwardly directed socket adapted to receive and support a generally vertically oriented lamp, and having a plurality of coupling members positioned around the socket; an upper reflector, coupled to the housing, and having at least a first portion located to reflect light from a lamp received in the socket; at least one reflector module; at least one fastener for coupling the at least one reflector module to at least one of said plurality of coupling members supported by the housing in a selected location to reflect light emitted from the lamp in a selected direction; and a refractor coupled to and extending downwardly from the housing, substantially enclosing the socket, upper reflector, and reflector module, and transmitting light from the lamp to the outside of the luminaire.

45 Claims, 16 Drawing Sheets

U.S. PATENT DOCUMENTS

| | | | | |
|---|---|---|---|---|
| D447,829 | S | 9/2001 | Bradford et al. | |
| 6,338,564 | B1 * | 1/2002 | Jordan et al. | 362/346 |
| 6,375,338 | B1 | 4/2002 | Cummings et al. | |
| 6,585,398 | B1 | 7/2003 | Haddad | |
| D482,816 | S | 11/2003 | Packer et al. | |
| D503,993 | S | 4/2005 | Yurich | |
| 7,244,050 | B2 * | 7/2007 | Summerford et al. | 362/327 |

* cited by examiner

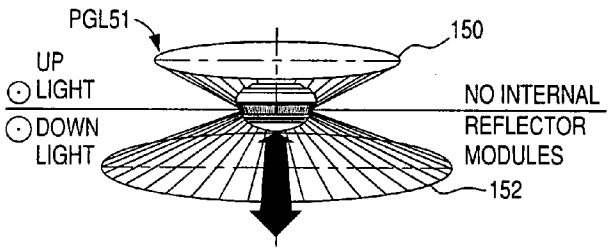
FIG. 21
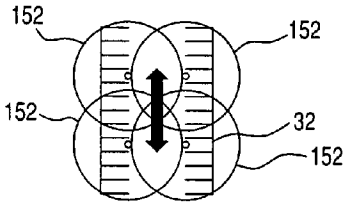
TWO-WAY DRIVE LANE
DOUBLE FIXTURE ROW
FIG. 22
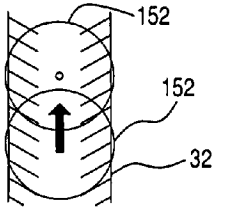
ONE-WAY DRIVE LANE
SINGLE FIXTURE ROW
FIG. 23
FIG. 24
TWO-WAY DRIVE LANE
DOUBLE FIXTURE ROW
FIG. 25
ONE-WAY DRIVE LANE
SINGLE FIXTURE ROW
FIG. 26
FIG. 27
TWO-WAY DRIVE LANE
SINGLE FIXTURE ROW
FIG. 28
ONE-WAY DRIVE LANE
SINGLE FIXTURE ROW
FIG. 29

ONE-WAY DRIVE LANE
SINGLE FIXTURE ROW

TWO-WAY DRIVE LANE
SINGLE FIXTURE ROW

GARAGE ENTRANCE OR
HIGH CEILING AREA

ONE-WAY DRIVE LANE
SINGLE FIXTURE ROW

ONE-WAY DRIVE LANE
SINGLE FIXTURE ROW

TWO-WAY DRIVE LANE
DOUBLE FIXTURE ROW

ONE-WAY DRIVE LANE
SINGLE FIXTURE ROW

TWO-WAY DRIVE LANE
DOUBLE FIXTURE ROW

PARKING GARAGE LUMINAIRE WITH INTERCHANGEABLE REFLECTOR MODULES

FIELD OF THE INVENTION

The invention relates to luminaires and especially luminaires useful in parking garages. The luminaire is capable of selectively directing light from a lamp therein generally upwardly, downwardly, and outwardly by use of a series of internal interchangeable reflectors. The reflectors include an upper reflector, and an optional set of single curved solid or apertured reflectors or double curved solid or apertured reflectors. The lamp and reflectors are supported by an upper electrical housing, and a generally hemispheric-shaped refractor is coupled to the housing and sealingly encloses the lamp and reflectors from exterior dust and water. The refractor reflects, directs, transmits, and disperses light emanating from the lamp.

BACKGROUND OF THE INVENTION

Lighting fixtures, also known as luminaires in the lighting industry, are widely used in parking structures including enclosed garages and partially enclosed mall parking areas. These parking garage luminaires provide an important safety function by effectively and efficiently illuminating these structures for both pedestrians and drivers.

Parking garage luminaires of advantageous designs should control glare, effectively shape the emitted light, and direct the light generally upwardly to avoid a cave-like effect, generally downwardly to illuminate the driving and walking surfaces, and generally outwardly to illuminate the sides of the structure, people and vehicles.

In addition, parking garage luminaires, which normally should have a working life of many years, should be reasonably simple, cost effective and efficient to make, assemble, install, use, maintain, and clean. All of these functions should be accomplished using as few parts and steps as possible, with as little waste as possible, and with reasonable energy efficiency. The manufacturing process should be as simple as possible with a limited inventory of parts and use of interchangeable, modular parts. Finally, these parking garage luminaires should be reasonably sealed from the outside to provide corrosion and dirt-resistance and allow power washing.

While many luminaires in general and many parking garage luminaires in particular are known in the prior art, they tend to inadequately provide many of the desirable features noted above.

Examples of known luminaires are disclosed in the following U.S. patents, the disclosures of which are hereby incorporated herein by reference: U.S. Pat. No. 3,700,883 to Donohue et al; U.S. Pat. No. 4,087,682 to Kolodziej; U.S. Pat. No. 4,231,080 to Compton; U.S. Pat. No. 4,338,655 to Gulliksen et al; U.S. Pat. No. 4,856,103 to Compton; U.S. Pat. No. 5,486,989 to Compton; U.S. Pat. No. 5,855,427 to Lassovsky; U.S. Pat. No. 6,036,338 to Gordin; U.S. Pat. No. 6,375,338 to Cummings et al; U.S. Pat. No. 6,585,398 to Haddad; and U.S. Pat. No. D361,400 to Compton.

SUMMARY OF THE INVENTION

Accordingly, it is a primary object of the luminaire disclosed and claimed herein to provide a light dispensing apparatus that is efficient and effective in controlling glare, and directing and shaping the emitted light.

Another object of the luminaire is that it is reasonably simple, cost effective, and efficient to make, assemble, install, use, maintain and clean.

Another object of the luminaire is to provide an effective lighting fixture using as few parts and manufacturing steps as possible, with as little waste as possible, and with reasonable energy efficiency.

A further object of the luminaire is to provide a lighting fixture requiring a limited inventory of parts and using interchangeable, modular parts.

A further object of the luminaire is to provide a lighting fixture that is reasonably sealed from the outside to provide corrosion and dirt resistance and allow power washing.

A further object of the luminaire is to selectively direct light generally upwardly, downwardly, and outwardly by use of a series of interchangeable reflector modules.

A further object of the luminaire is to provide a refractor that seals the lamp and reflectors inside the luminaire to resist the effects of exterior dirt and water, and that reflects, directs, transmits, and disperses light emanating from the lamp for efficient and effective use of the light and electrical energy generating the light.

The foregoing objects are basically attained by a luminaire capable of selectively directing light from a lamp therein generally upwardly, downwardly, and outwardly, the combination comprising an electrical housing having a generally downwardly directed socket adapted to receive and support a generally vertically oriented lamp, and having a plurality of coupling members positioned around said socket; an upper reflector, coupled to said housing, and having at least a first portion located to reflect light from a lamp received in said socket; at least one reflector module; at least one fastener for coupling said at least one reflector module to at least one of said plurality of coupling members supported by said housing in a selected location to reflect light emitted from the lamp in a selected direction; and a refractor coupled to and extending downwardly from said housing, substantially enclosing said socket, upper reflector, and reflector module, and transmitting light from the lamp to the outside of the luminaire.

The foregoing objects are also basically attained by a luminaire, the combination comprising an electrical housing having a generally downwardly directed socket adapted to receive and support a generally vertically oriented lamp; an upper reflector, coupled to said housing, and having at least a first portion located above the bottom of said socket, a substantially frustoconical second portion extending downwardly and outwardly relative to said socket and located substantially around the sides of said socket, and a substantially annular portion having a plurality of coupling members thereon; and a refractor coupled to and extending downwardly from said housing, substantially enclosing said socket, and upper reflector, and transmitting light from the lamp to the outside of the luminaire.

The foregoing objects are also basically attained by a luminaire capable of selectively directing light from a lamp therein generally upwardly, downwardly, and outwardly, the combination comprising an electrical housing having a generally downwardly directed socket adapted to receive and support a generally vertically oriented lamp, and having a plurality of coupling members positioned around said socket; an upper reflector, coupled to said housing, and having at least a first portion located to reflect light from a lamp received in said socket; at least one reflector module comprising a solid single curved reflector, an apertured single curved reflector, a solid double curved reflector, or an apertured double curved reflector; at least one fastener for coupling said at least one reflector module to at least one of said plurality of coupling members supported by said housing in a selected location to reflect light emitted from the lamp in a selected direction; and a refractor coupled to and extending downwardly from said housing, substantially enclosing said socket, upper reflector, and reflector module, and transmitting light from the lamp to the outside of the luminaire.

Other objects, advantages, and salient features of the luminaire will become apparent from the following detailed description, which, taken in conjunction with the annexed drawings, discloses preferred embodiments of the invention as defined in the annexed claims.

BRIEF DESCRIPTION OF THE DRAWINGS

Referring now to the drawings which form a part of this original disclosure:

FIG. 21 is a diagrammatic side elevational view of the luminaire and its illumination pattern without the use of reflector modules;

FIG. 22 is a diagrammatic top plan view of the lower illumination pattern created by four of the luminaires in FIG. 21 based on a double fixture row;

FIG. 23 is a diagrammatic top plan view of the lower illumination pattern created by two of the luminaires in FIG. 21 based on a single fixture row;

FIG. 24 is a diagrammatic side elevational view of the luminaire and its illumination pattern with the use of four apertured curved reflector modules;

FIG. 25 is a diagrammatic top plan view of the lower illumination pattern created by four of the luminaires in FIG. 24 based on a double fixture row;

FIG. 26 is a diagrammatic top plan view of the lower illumination pattern created by two of the luminaires in FIG. 24 based on a single fixture row;

FIG. 27 is a diagrammatic side elevational view of the luminaire and its illumination pattern with the use of two apertured double curved reflector modules oriented perpendicular to traffic flow;

FIG. 28 is a diagrammatic top plan view of the lower illumination pattern created by three of the luminaires in FIG. 27 based on a two-way drive lane and a single fixture row;

FIG. 29 is a diagrammatic top plan view of the lower illumination pattern created by three of the luminaires in FIG. 27 based on a one-way drive lane and a single fixture row;

DETAILED DESCRIPTION OF THE PREFERRED EMBODIMENTS

Figure 1:
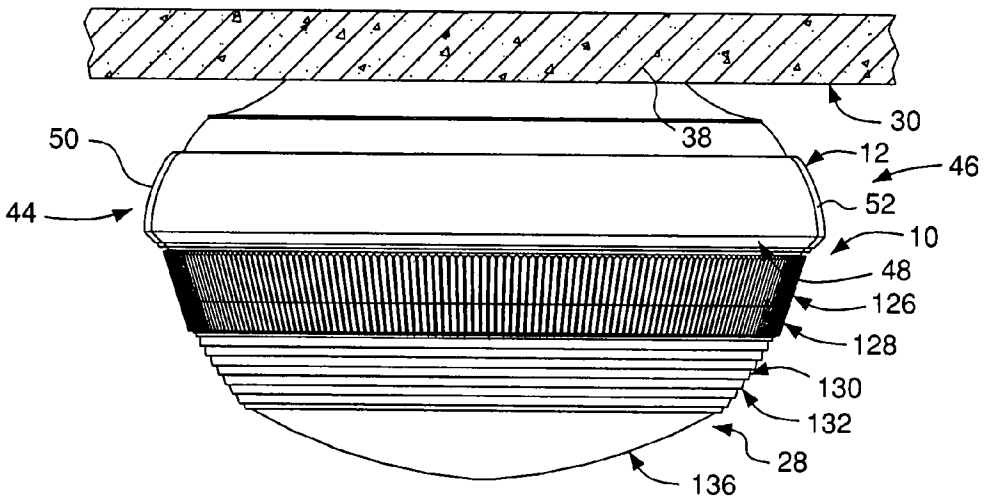
FIG. 1 is a side elevational view of the luminaire in accordance with the present invention as attached to a ceiling.
Figure 2:
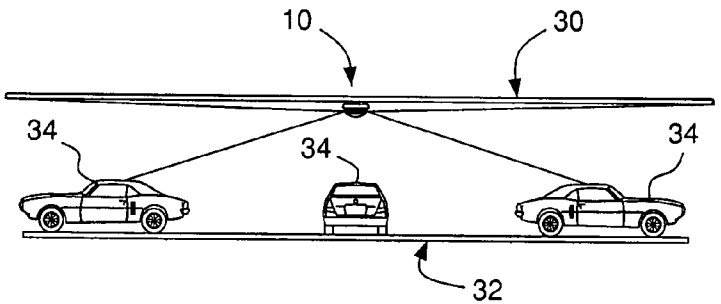
FIG. 2 is a diagrammatic side elevational view of the luminaire used, for example, in a parking structure.

As best seen in FIGS. 1-18, the luminaire 10 in accordance with the invention generally comprises an electrical housing 12, an upper reflector 14 coupled thereto, a socket 26 for the lamp 18 received in the upper reflector, a set of optional apertured and solid single curved and double curved internal reflector modules 20, 22, 24, and 26, and a refractor 28 coupled to the housing 12 and enclosing the lamp, socket, upper reflector, and reflector modules.

As seen in FIGS. 1-18, the luminaire 10 in accordance with the invention is advantageously useful in a parking garage including a ceiling 30 and a floor 32 with vehicles 34 parked and moving therethrough. The luminaire 10 is capable of selectively directing light from the lamp 18 therein generally upwardly, downwardly, and outwardly as seen in FIGS. 2, 5, 7, 9 and 21-42 via use of the upper reflector 14, the series of optional internal reflector modules 20, 22, 24 and 26, and the refractor 28.

As best seen in FIGS. 3, 4, and 7-18, the internal reflector modules comprise two or four apertured single curved reflector modules 20, two or four solid single curved reflector modules 22, two apertured double curved reflector modules 24, and two solid double curved reflector modules 26, which help to direct the light outwardly and downwardly. The apertures in some of the reflector modules allow more of the light to be emitted generally upwardly.

The upper reflector 14 has several frustoconical surfaces which help to reflect the light downwardly and outwardly.

The refractor 28 has several sections that can reflect, disperse, redirect, and transmit the light from the lamp 18 and from the upper reflector 14 and reflector modules 20, 22, 24, and 26. The luminaire 10 includes the electrical housing 12 which supports a ballast 36 suitably connected to the lamp 18 as needed, the socket 16 for the lamp 18, the upper reflector 14 and reflector modules 20, 22, 24 and 26, and which is sealingly coupled to and supports the refractor 28. This construction helps to keep contaminants, such as dust and water, from entering the inside of the luminaire.

The Electrical Housing

As seen in FIGS. 1 and 4-10, the electrical housing 12 has a flat top surface 38, a front side 40, a rear side 42, a left side 44, a right side 46, and an annular lower member 48 supporting two pivotable access latches 50 and 52. Suitable and conventional electrical power lines pass through the top surface 38 to provide electrical power to the luminaire lamp. The luminaire is conventionally supported on the bottom of the ceiling 30 of the garage via connectors, bolts, or other suitable fasteners.

Figure 4:
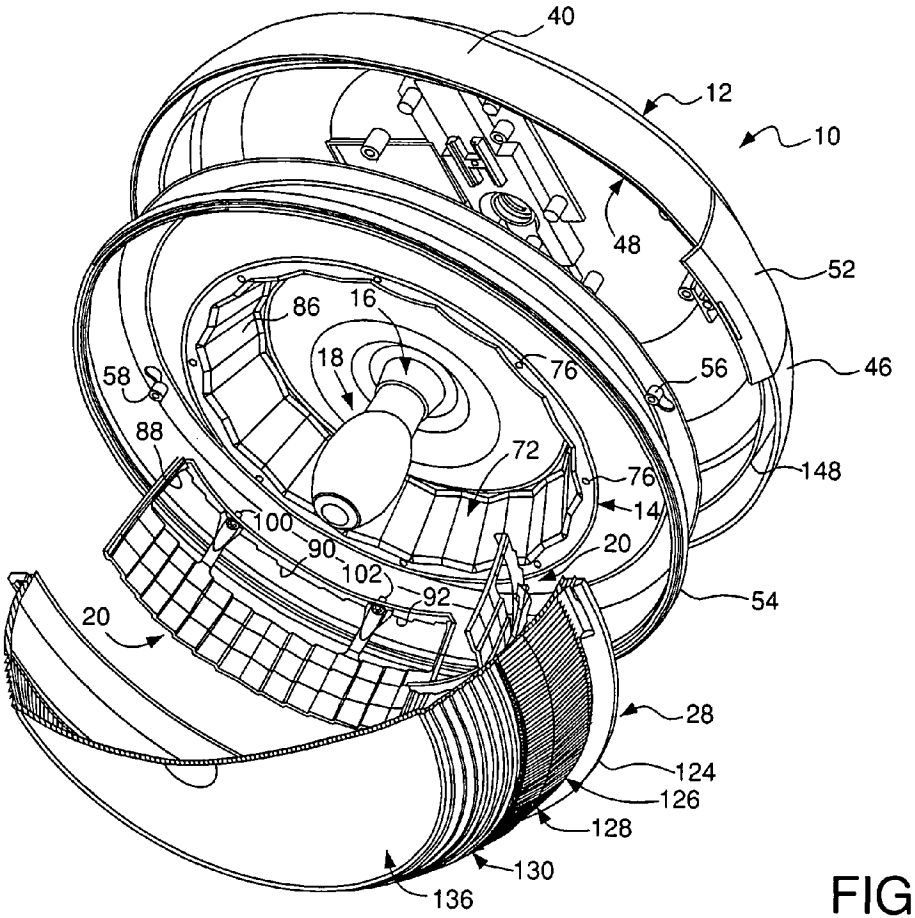
FIG. 4 is an exploded side perspective view of the luminaire showing the electrical housing, upper reflector, socket, lamp, two apertured single curved reflectors, and a portion of the refractor.
Figure 5:
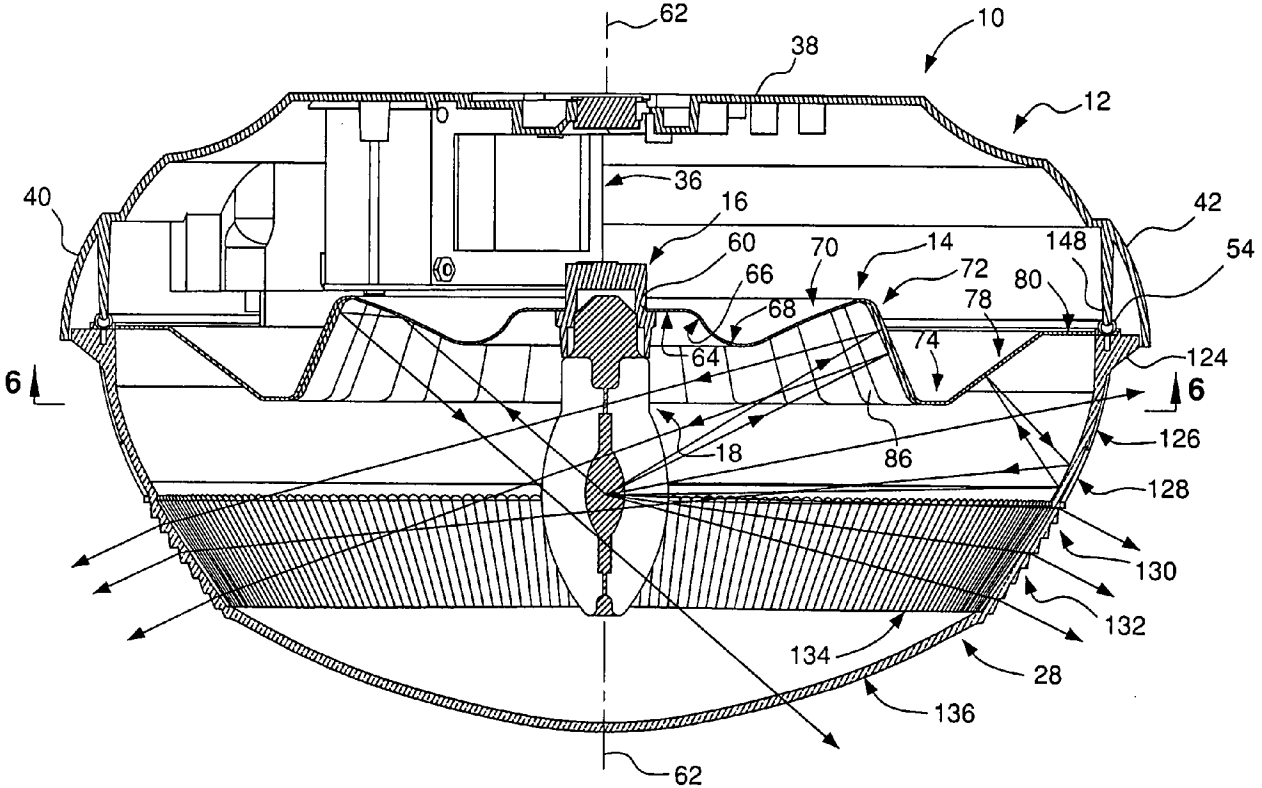
FIG. 5 is a side elevational view of the luminaire in vertical section showing the electrical housing, the upper reflector without any reflector modules coupled thereto, the socket, the lamp, and the refractor, as well as a diagrammatic representation of some exemplary light rays emanating from the lamp, and being reflected by the upper reflector and reflected, dispersed, and refracted by the refractor.

A circular gasket 54 is coupled to the top of the refractor 28, as seen in FIGS. 4 and 5, for example, and engages the annular member 148 in lower annular portion 48 of the electrical housing to provide a sealing engagement therebetween.

As seen in FIGS. 4, 6, 8, and 10, two hand-tightenable threaded fasteners 56 and 58 with knurled cylindrical heads extend downwardly from and are suitably threadedly coupled to two threaded bores in the lower portion 48 of the electrical housing. These threaded fasteners 56 and 58 are used to couple the upper reflector 14 to the housing 12 as shown.

The electrical socket 16 is suitably electrically connected to the electrical power lines entering the interior of the housing 12 and is rigidly supported in a substantially vertical position in a central aperture 60 in the upper reflector 14, which is in turn rigidly supported by the housing. The socket 16 could also be supported in whole or in part by the housing directly. At least a portion of the upper reflector is located substantially above the bottom of the socket for effective reflection of the light.

Figure 7:
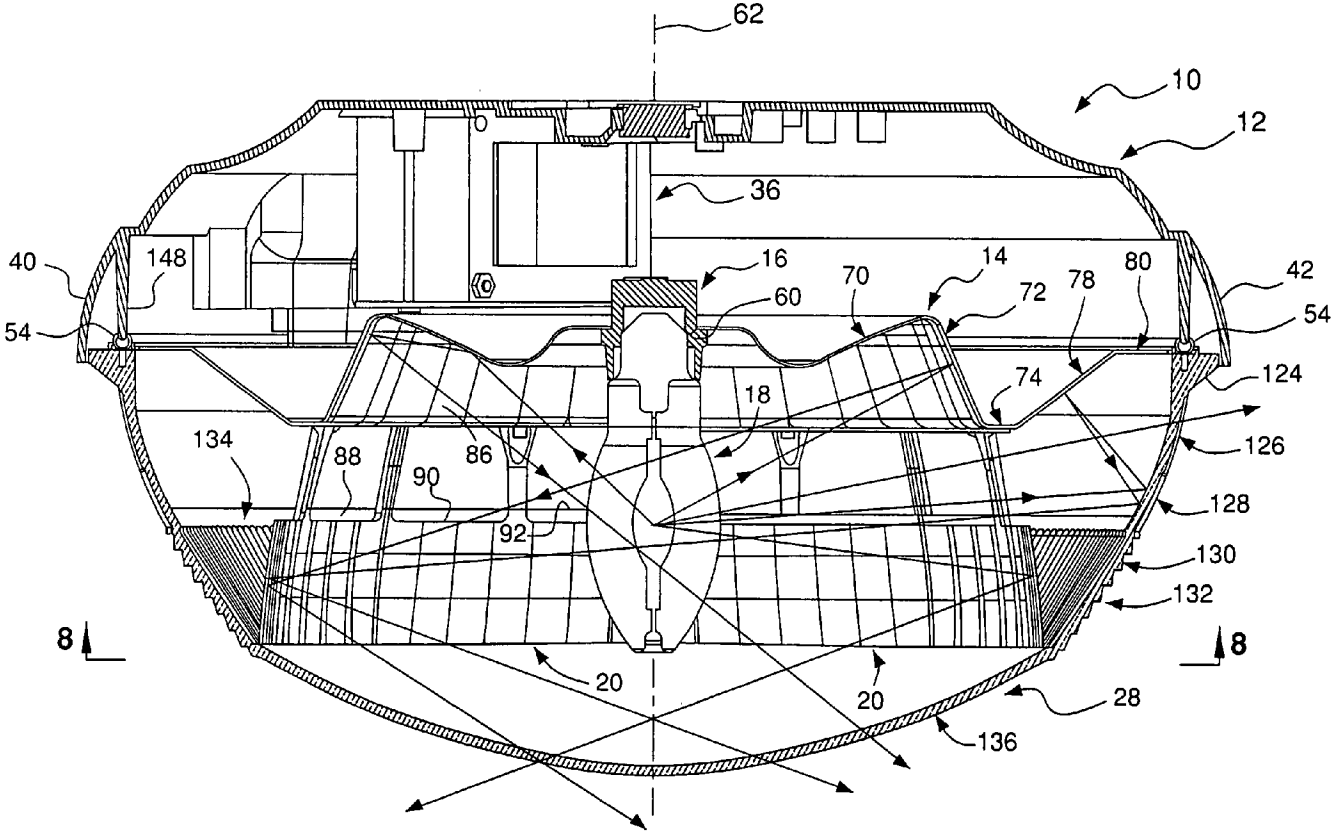
FIG. 7 is a side elevational view of the luminaire in vertical section with the same construction as the luminaire in FIG. 5 but with the addition of four apertured single curved reflector modules, as well as additional diagrammatic representations of some exemplary light rays emanating from the lamp, and being reflected by the upper reflector and reflected, dispersed, and refracted by the refractor.
Figure 9:
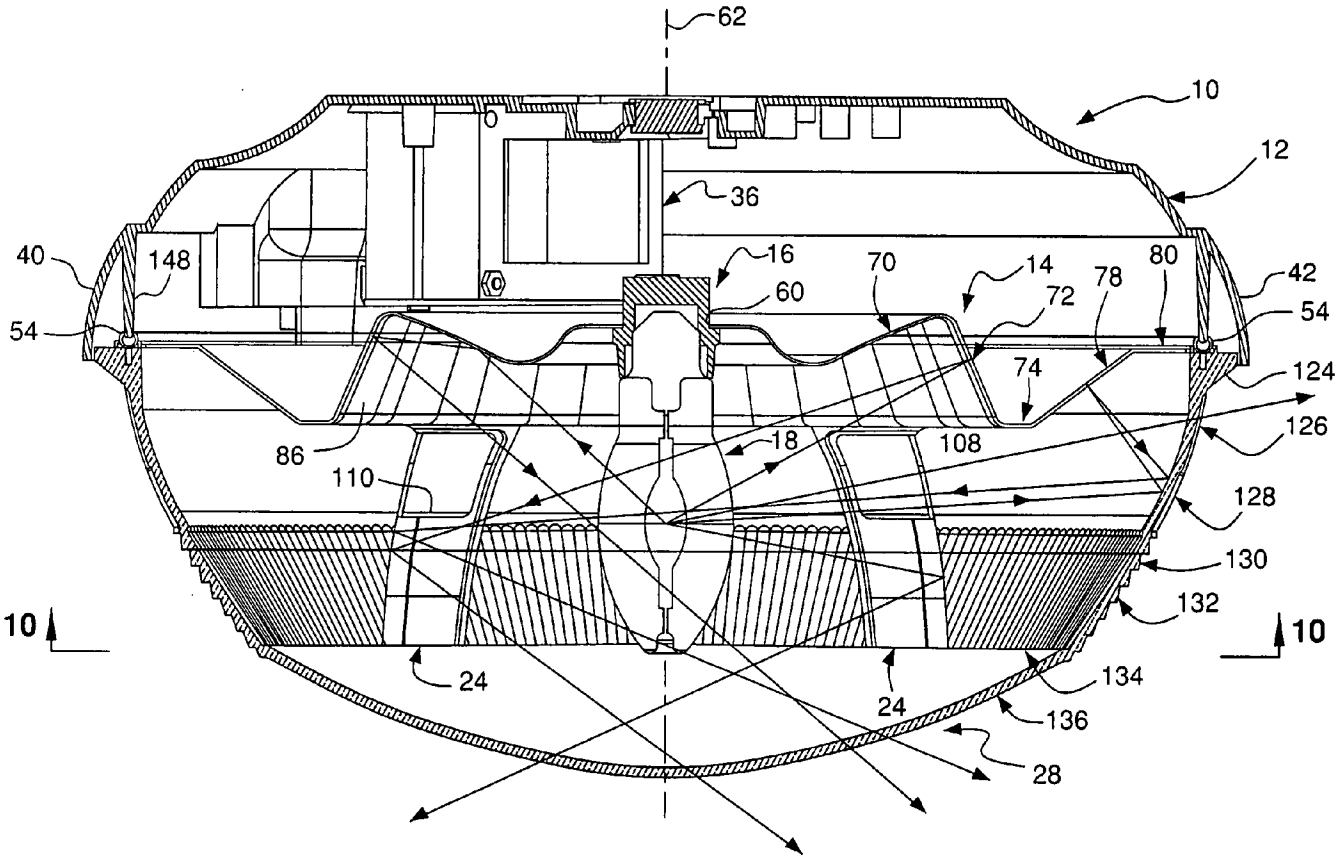
FIG. 9 is a side elevational view of the luminaire in vertical section with the same construction as the luminaire in FIG. 5 but with the addition of two apertured double curved reflector modules, as well as additional diagrammatic representations of some exemplary light rays emanating from the lamp, and being reflected by the upper reflector and reflected, dispersed, and refracted by the refractor.

The vertically longitudinal center of the socket 16 advantageously defines a vertical central axis 62 for the overall luminaire 10 as seen in FIGS. 5, 7, and 9 and helps define four 90° quadrants or areas A, B, C and D about that axis in connection with the annular upper reflector 14.

The lamp 18 is suitably electrically received and mechanically supported by socket 16. Lamp 18 can be a high intensity discharge or fluorescent lamp, for example.

The Upper Reflector

The upper reflector 14 could just be a flat disk, but it is advantageously constructed with various frustoconical surfaces to improve its reflectivity of the light from the lamp 18 and is oriented generally horizontally and perpendicular to the socket and lamp.

As seen in FIGS. 4-10, the upper reflector comprises the central aperture 60, a flat annular portion 64, a downwardly and outwardly tapered frustoconical portion 66, a curved annular portion 68, an upwardly and outwardly tapered frustoconical portion 70, a second downwardly and outwardly tapered frustoconical portion 72 angled at about 66° to a plane perpendicular to axis 62, a second flat annular portion 74 with eight equally annularly spaced threaded bores 76 therein forming coupling members, a second upwardly and outwardly tapered frustoconical portion 78, angled at about 45° to a plane perpendicular to axis 62, and an outer flat annular portion 80 having two key hole slots 82 and 84 therein for receiving threaded fasteners 56 and 58 therein to rigidly support the upper reflector 14 on the housing 12. As discussed below in further detail, threaded bores 76 will threadedly receive suitable threaded fasteners or other suitable fastening devices to rigidly couple the selected reflector modules to the upper reflector 14 in selected locations. Although shown as eight threaded bores, these coupling members could be any suitable coupling devices and more or less than eight.

Frustoconical portion 72 is advantageously subdivided into a plurality of segments 86 that are oriented at an angle of about 148° between adjacent segments. This construction prevents light from being reflected from portion 72 back into lamp 18, which could be destructive. The bottom of the upper reflector 14 lies in the plane containing annular portion 74, which plane is perpendicular to axis 62 and intersects section 126 in the refractor about one-third down from the top of section 126.

The Internal Reflector Modules and Their Fasteners

Figure 6:
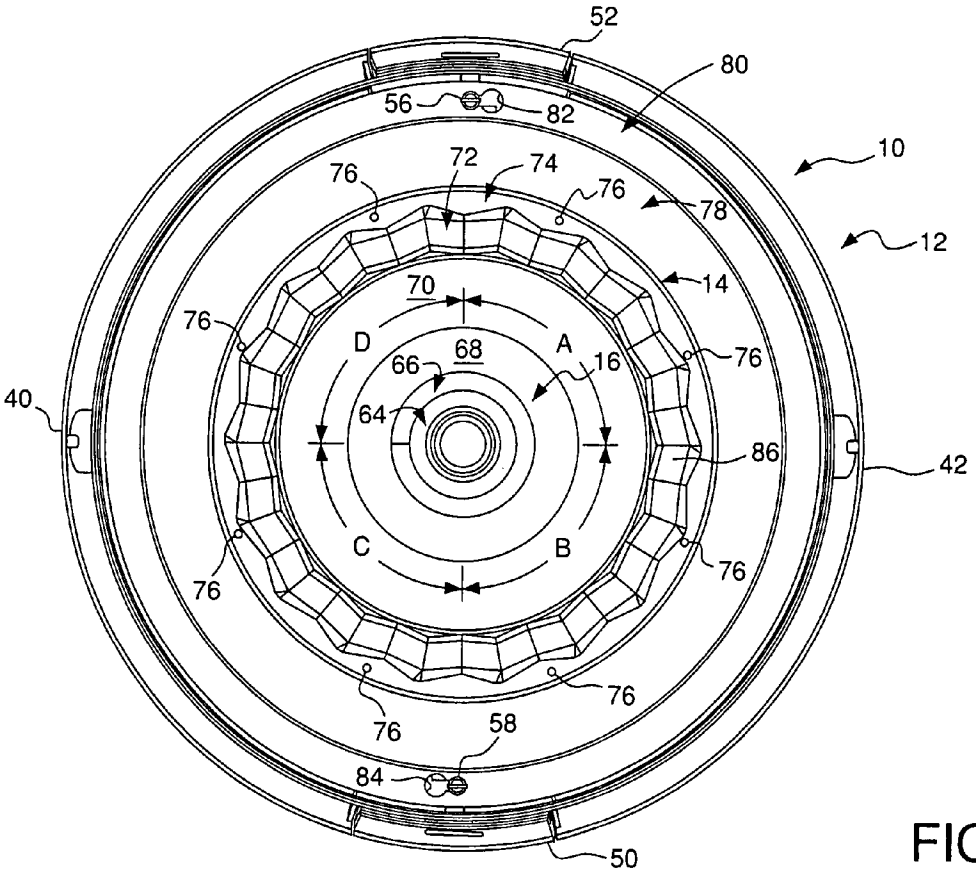
FIG. 6 is a bottom plan view in section taken along line 6-6 in FIG. 5 of the luminaire shown in FIG. 5.

As best seen in FIGS. 3, 4, and 7-18, there are four different types of optional internal reflectors or reflector modules 20, 22, 24, and 26 that can be used with luminaire 10 as preselected and depending upon the shape and direction of the light selected to be emitted from the luminaire 10. In addition, as seen in FIGS. 5, and 6, none of the reflector modules need to be used to create an illumination pattern shown, for example, in FIGS. 21-23.

Figure 3:
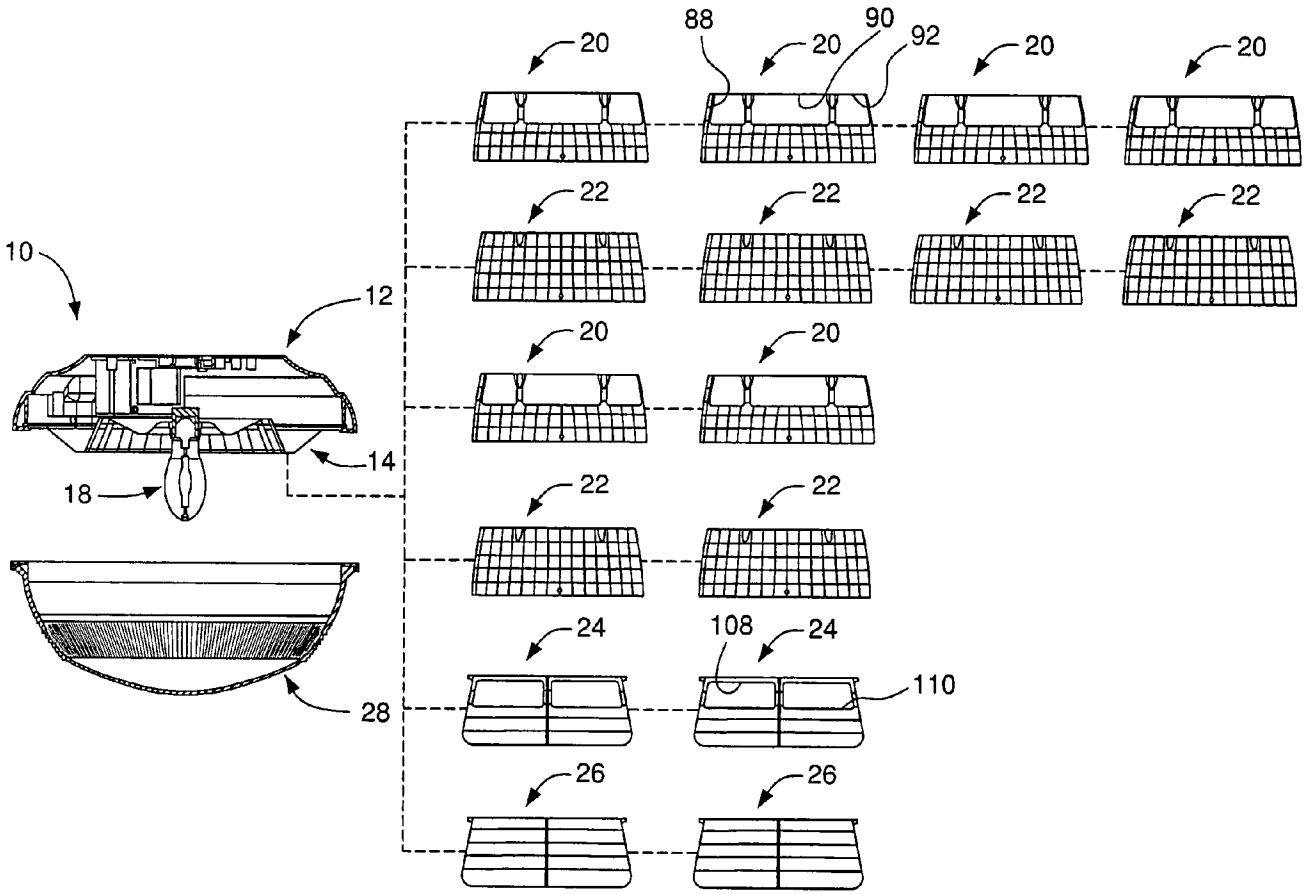
FIG. 3 is a diagrammatic side elevational view of the luminaire showing the electrical housing, socket, lamp, and refractor in vertical cross section and the collection of apertured and solid single curved reflector modules and apertured and solid double curved reflector modules usable with the luminaire.

As best shown in FIG. 3, as well as FIGS. 4-14 and diagrammatically in FIGS. 21-24, 27, 30, 33, 35, 37 and 40, there are various permutations relative to the selection of the reflector modules for effective light direction. Their location in the various quadrants A-D can also be chosen for light direction purposes.

The basic permutations include four apertured single curved reflector modules 20, four solid single curved reflector modules 22, two apertured curved reflector modules 20, two solid single curved reflector modules 22, two apertured double curved reflector modules 24, and two solid double curve reflector modules 26. For further customization, these different types of modules can be variously used as advantageous and efficient.

As seen in FIGS. 7 and 9, whenever the apertured reflector modules are used, there tends to be more light directed generally upwardly from the luminaire 10 than when the solid, or restricted uplight, reflector modules are used. Thus, FIGS. 21, 24, 27, 30, 35, 37 and 40 generally depict the use of apertured reflector modules, and if the solid reflector modules were substituted therefor, then there would be no or less uplight emitted by the luminaires. If four solid curved reflector modules are used, generally there is no uplight. If two solid curved or double curved reflector modules are used, there will be uplight, but it will be restricted.

Figure 11:
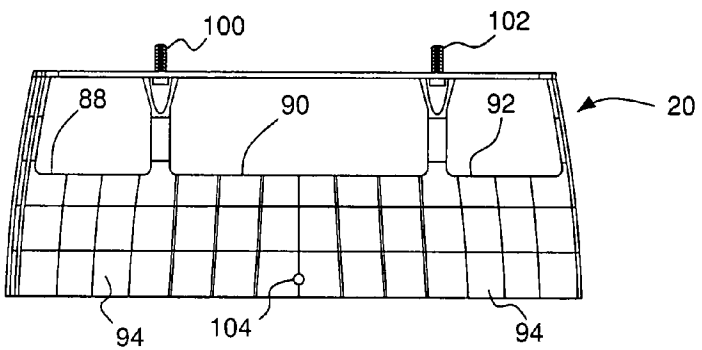
FIG. 11 is a side elevational view of the concave side of an apertured single curved reflector module also shown in FIGS. 7 and 8.
Figure 12:
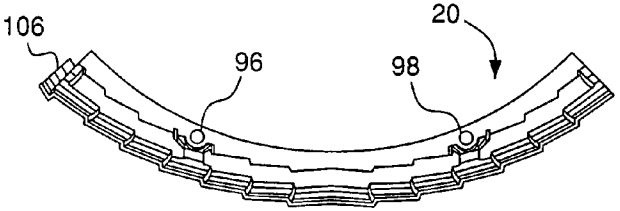
FIG. 12 is a bottom plan view of the apertured single curved reflector module as shown in FIGS. 7, 8 and 11.

The basic apertured single curved reflector module 20 is shown in bottom plan view in FIG. 12 and side elevation in FIG. 11 on the concave side having three light-transmitting, through apertures or windows 88, 90 and 92 therein extending in a direction generally transverse to the concave surface on the module. The concave surface has a plurality of angled facets 94 thereon to avoid reflecting light back into the lamp 18 and has a substantially uniform curvature. Two vertically oriented openings 96 and 98 formed in the reflector module receive two threaded fasteners 100 and 102 therein to couple the module to the upper reflector 14 via threaded bores 76 as discussed above and shown in FIG. 7. A horizontally oriented threaded bore 104 is formed in the middle of the module to receive a threaded fastener as described below to attach a houseside shield 138 to the luminaire 10 as selected. To avoid any light leaks by a space between adjacent reflector modules 20, an end recess 106 is formed at one end of each module to receive and overlap with the end of the adjacent module.

Figure 13:
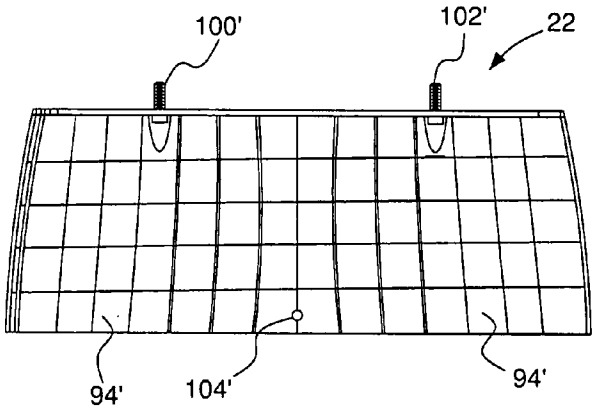
FIG. 13 is a side elevational view of the concave side of a solid single curved reflector module.
Figure 14:
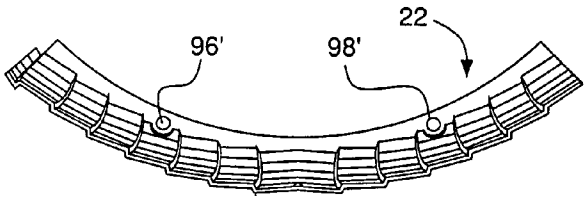
FIG. 14 is a bottom plan view of the solid single curved reflector module as shown in FIG. 13.

The basic solid, or non-apertured, reflector module 22 is shown in side elevation in FIG. 13 and bottom plan in FIG. 14. Module 22 is the same as module 20 except it does not have any light-transmitting apertures. Therefore, like reference numerals are used with module 22 with the addition of a prime.

As seen in FIGS. 12 and 14, modules 20 and 22 encompass about 90° or one quarter arc of a circle. These modules could encompass larger or smaller angles as appropriate.

Rather than using the threaded fasteners 100, 102, 100, and 102, other suitable fasteners or even adhesive could be used as appropriate and advantageous.

Figure 15:
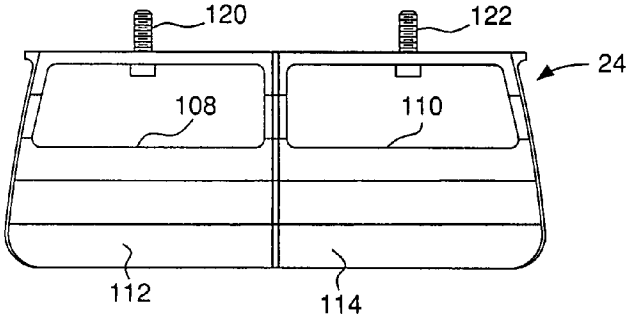
FIG. 15 is a side elevational view of the concave sides of an apertured double curved reflector module also shown in FIGS. 9 and 10.
Figure 16:
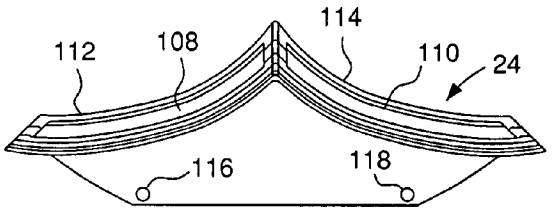
FIG. 16 is a bottom plan view of the apertured double curved reflector module as shown in FIGS. 9, 10 and 15.

The basic apertured double curved, or gull-wing shaped, reflector module 24 is shown in bottom plan view in FIG. 16 and side elevation in FIG. 15 on the concave sides having two through apertures or windows 108 and 110 therein extending in a direction generally transverse to the concave surfaces 112 and 114 on the module. The two concave curved surfaces 112 and 114 are constructed and curved to avoid reflecting light back into the lamp 18 and have a linear portion 115 between them. Two vertically oriented openings 116 and 118 formed in the reflector module receive two threaded fasteners 120 and 122 therein to couple the module to the upper reflector 14 via threaded bores 76 as discussed above and shown in FIG. 10.

Figure 17:
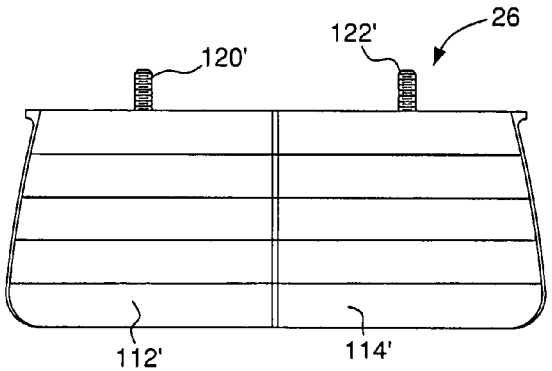
FIG. 17 is a side elevational view of the concave sides of a solid double curved reflector module.
Figure 18:
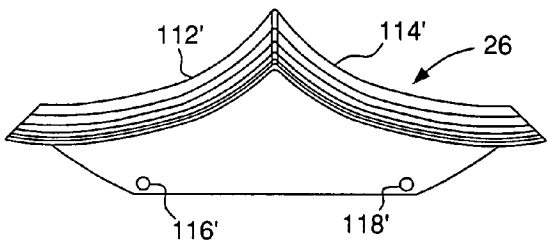
FIG. 18 is a bottom plan view of the solid double curved reflector module as shown in FIG. 17.

The basic solid, or non-apertured, reflector module 26 is shown in side elevation in FIG. 17 and bottom plan view in FIG. 18. Module 26 is the same as module 24 except that it does not have any light transmitting apertures. Therefore, like reference numerals are used with module 26 with the addition of a prime.

As seen in FIGS. 16 and 18, modules 24 and 26 have curved surfaces that encompass about 60°, but these surfaces could have larger or smaller angles if appropriate.

Rather than using the threaded fasteners 120, 122, 120', and 122', other suitable fasteners or even adhesive could be used.

As seen in FIGS. 7 and 9, the bottoms of the curved reflector modules 20 and the double curved reflector modules 24 as supported by the upper reflector lie in a plane that is substantially perpendicular to axis 62 and substantially intersects the refractor 28 at the interface between sections 130 and 136.

The Refractor

As seen in FIGS. 1-5, 7, and 9, the refractor 28 is rigidly coupled to and below the electrical housing 12 and encloses the upper reflector 14, socket 16, lamp 18, and the internal reflector modules 20, 22, 24 and 26 therein. The refractor can be made of plastic and is generally translucent or transparent to light.

At the top, the refractor 28 has an outwardly extending annular rim 124 which receives the gasket 54 therein and which releasably receives the two access latches 50 and 52 to couple the refractor to the housing.

The refractor 28 is generally hemispherical in shape and has several differently constructed horizontally oriented, annular sections or bands located below rim 124, which also perform various different functions.

The first section 126 is an annular band formed by vertically oriented flutes or prisms on the exterior of the refractor, the included angle of the prisms being less than 42°. This first section 126 allows light to be transmitted therethrough but it tends to spread the image of the light beam and lessen glare.

The second section 128 is below section 126 and is an annular band formed by vertically oriented flutes or prisms on the exterior of the refractor, the included angle of the prisms being greater than 42°. This second section 128 reflects light incident thereon from the inside of the luminaire back into the luminaire.

The third section 130 is below section 128 and includes an annular band formed by a set 132 of horizontally oriented annular prisms on the exterior surface that bend or refract light passing therethrough to a more useful downward direction.

This third section 130 also includes on the interior surface an annular band formed by vertically oriented flutes or prisms 134 that scatters and spreads the light passing therethrough horizontally to reduce apparent glare.

Finally, the lowermost fourth section 136 is below section 130 and is substantially shaped like an inverted dome or portion of a sphere. It is substantially transparent to the light emitted from the lamp and allows the light to exit the luminaire in downward and outward directions.

As seen in FIGS. 1, 5, 7, 9, and 19, first and second sections 126 and 128 have substantially the same height, with section 126 being slightly larger, and these two sections 126 and 128 extend substantially one-third the height of the refractor below the rim 124. The third section 130 and the fourth section 136 each extend substantially one-third the height of the refractor below the rim.

The Optional Houseside Shield

Figure 19:
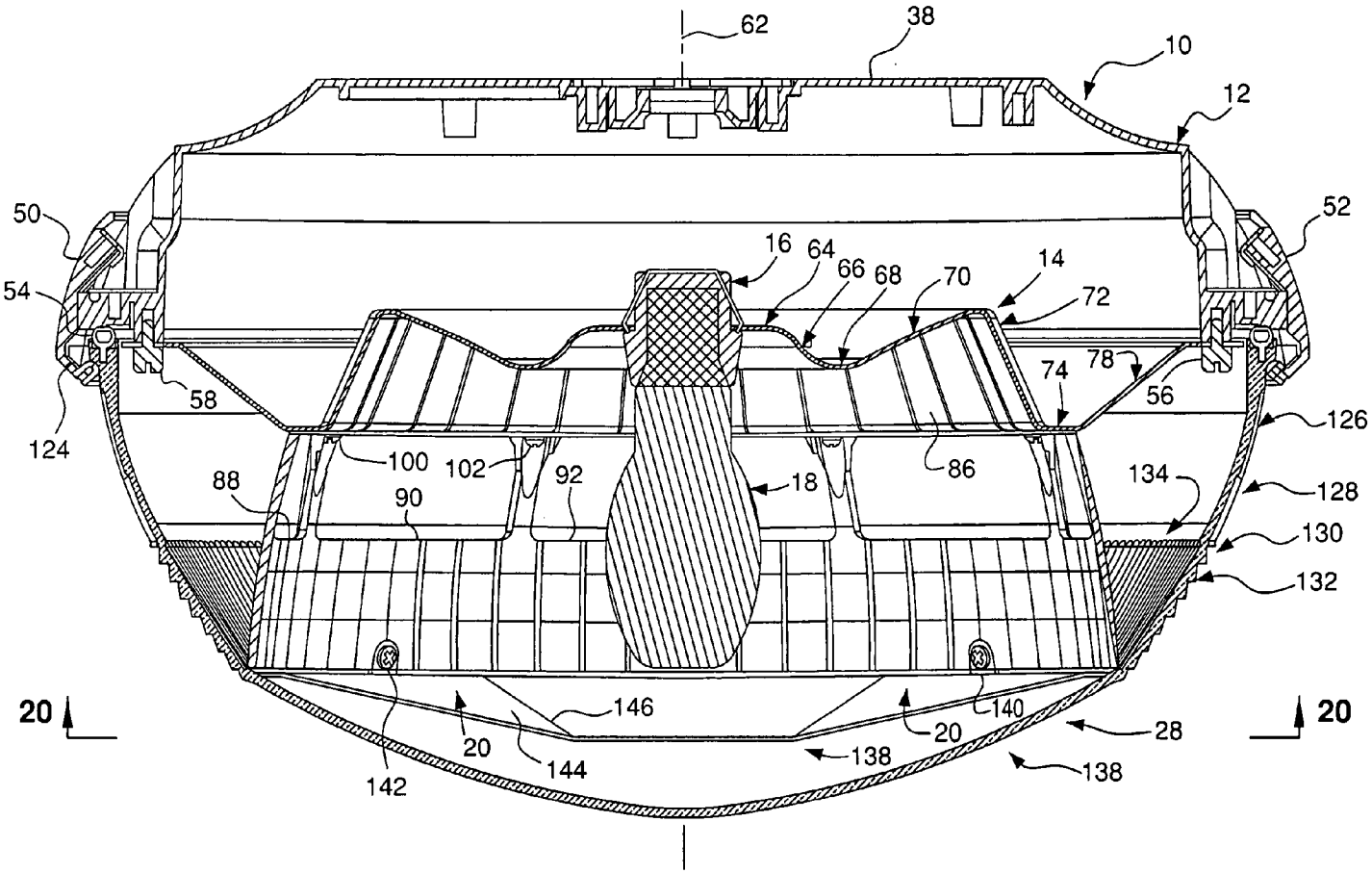
FIG. 19 is a side elevational view in vertical section of the luminaire shown in FIG. 7 but with the addition of a houseside shield to block unwanted light otherwise directed towards a house or other light-sensitive structure.
Figure 20:
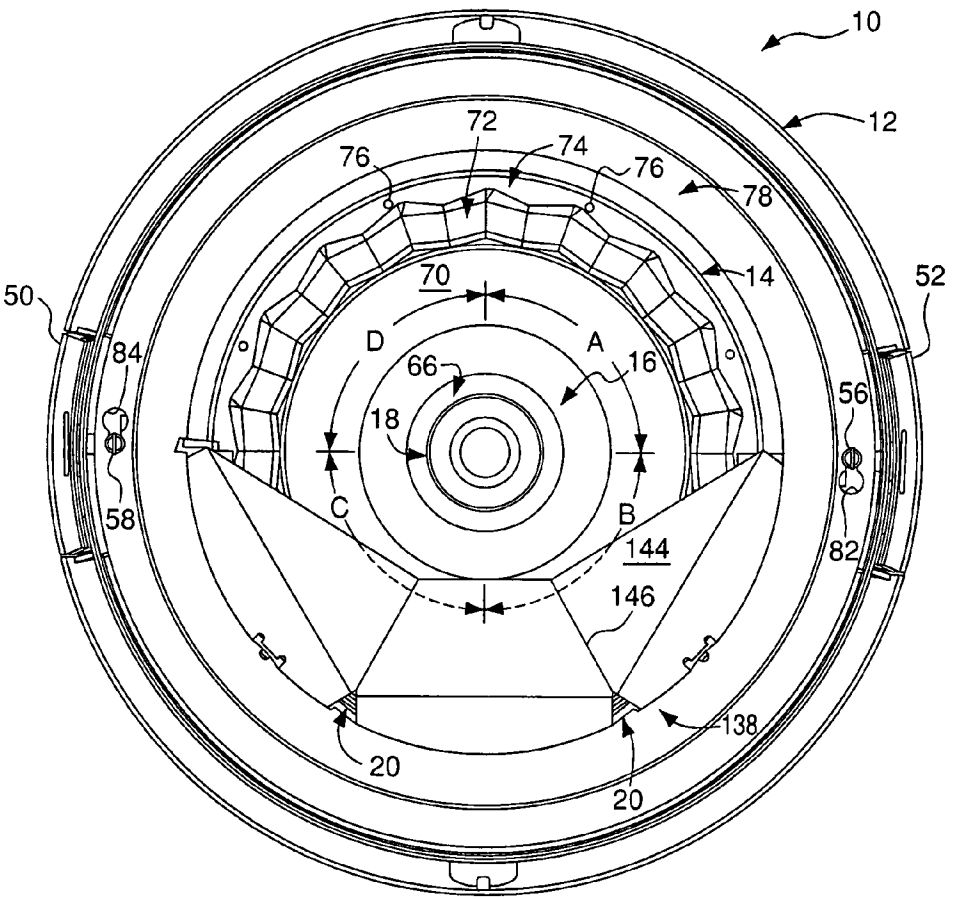
FIG. 20 is a bottom plan view in section taken along line 20-20 in FIG. 19 of the luminaire with the houseside shield shown in FIG. 19.
Figure 32:
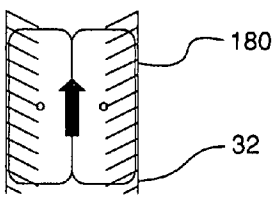
FIG. 32 is a diagrammatic top plan view of the illumination pattern created by two of the luminaires in FIG. 30 based on a one-way drive lane and a single fixture row.
Figure 31:
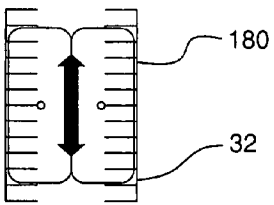
FIG. 31 is a diagrammatic top plan view of the illumination pattern created by two of the luminaires in FIG. 30 based on a two-way drive lane and a single fixture row.
Figure 35:
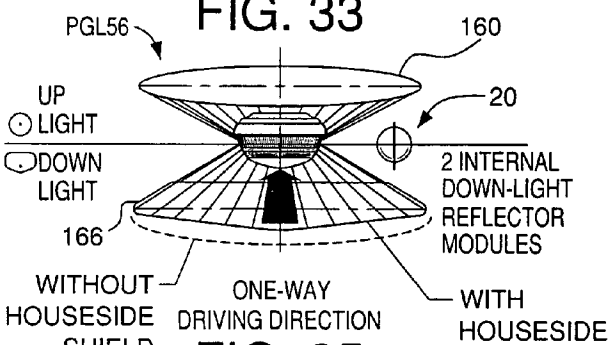
FIG. 35 is a diagrammatic side elevational view of the luminaire and its illumination pattern with the use of two apertured curved reflector modules located in only two quadrants of the luminaire and generally transverse of the traffic flow, and with and without the use of the optional houseside shield.
Figure 37:
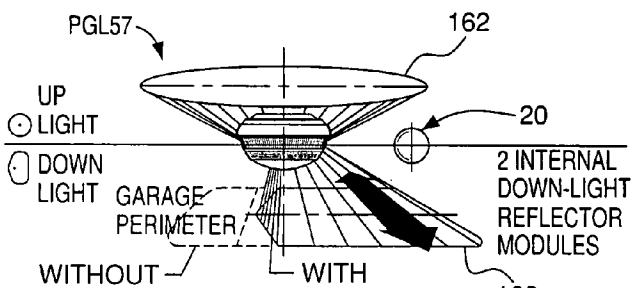
FIG. 37 is a diagrammatic side elevational view of the luminaire and its illumination pattern with the use of two apertured curved reflector modules located in only two quadrants of the luminaire and generally parallel to and on the left side of the traffic flow, and with and without the use of the optional houseside shield.
Figure 40:
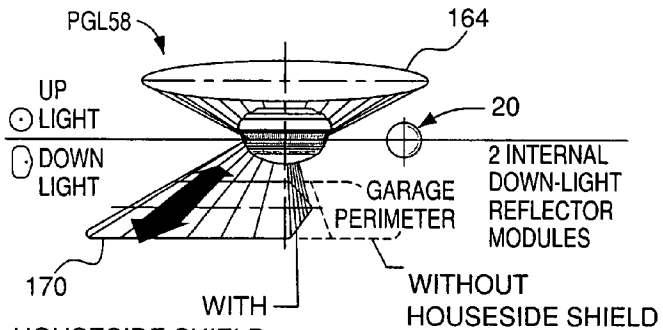
FIG. 40 is a diagrammatic side elevational view of the luminaire and its illumination pattern with the use of two apertured curved reflector modules located in only two quadrants of the luminaire and generally parallel to and on the right side of the traffic flow, and with and without the use of the optional houseside shield.

As seen in FIGS. 19-20 and diagrammatically in FIGS. 35, 37, and 40, luminaire 10 can be fitted with a houseside shield 138 to cut off direct lamp light approximately one mounting-height behind the fixture. The houseside shield 138 is especially useful if a house or other light-sensitive structure is located closely adjacent the luminaire.

The houseside shield 138 is advantageously formed of opaque aluminum sheet and is attached adjacent the bottom edges of the single curved reflector modules via threaded fasteners 140 and 142 passing therethrough and into threaded bores 104 or 104' in the reflector modules 20 or 22. As seen in FIGS. 19 and 20, the houseside shield 138 is advantageously formed by a plurality of panels 144 connected by fold lines 146. The houseside shield 138 extends about 180° and is located in quadrants B and C, as seen in FIGS. 19 and 20, although it could be made larger or smaller.

Assembly of the Luminaire

To assemble the luminaire 10, the assembler first determines which of the reflector modules 20, 22, 24, and 26 are selected and whether a houseside shield 138 is necessary or advantageous.

The selected reflector modules are then fastened to the electrical housing 12 by being directly coupled to the upper reflector 14 by use of the annular set of threaded bores 76 in the upper reflector 14 and the relevant threaded fasteners 100, 102, 100', 102', 120, 122, 120', and 122' associated with the corresponding reflector module 20, 22, 24, or 26, as seen in FIGS. 3, 4, 7-20 and diagrammatically in FIGS. 24, 27, 30, 33, 35, 37, and 40. Alternatively, the reflector modules could be directly coupled to the housing 12. The single curved reflector modules advantageously have the center of their radius of curvature coincident with central axis 62 of the housing.

As selected, the houseside shield 138 can then be coupled to the bottoms of the curved reflector modules 20 or 22 via threaded fasteners 140 and 142 as seen in FIGS. 35, 37, and 40. Rather than the threaded fasteners, other suitable fasteners or even adhesive could be used as effective and advantageous.

In some instances, none of the reflector modules are selected, and thus the upper reflector 14 is directly connected by itself to the electrical housing 12 via threaded fasteners 56 and 58 receivable on the housing and the key hole slots 82 and 84 in the upper reflector 14, as seen in FIG. 6. Alternatively, as advantageous, the upper reflector 14 could be coupled to the housing 12 and then the reflector modules could be coupled to the upper reflector.

At the appropriate time, such as after shipping or installation, the lamp 18 is electrically and mechanically received in the socket 16, which is supported by the electrical housing, as seen in FIGS. 4, 5, 7, 9, 19, and 20. Advantageously, the bottom of lamp 18 is substantially received in a horizontal plane passing through the refractor 28 adjacent the bottom of third section 130, and the middle of lamp 18 is substantially received in a horizontal plane passing through the refractor adjacent the top of third section 130, the lamp 18 being substantially perpendicular to the generally horizontally extending upper reflector 14.

To complete the assembly, the refractor 28 is coupled to the housing 12 via use of the two access latches 50 and 52, which grip annular rim 124 on the top of the refractor. As seen, for example, in FIG. 5, in this closed position the annular gasket 54 on the refractor engages the continuous annular member 148 in the housing to provide a substantially liquid-resistant and gas-resistant seal between the refractor and housing.

Once assembled, the luminaire is installed mechanically and electrically on the ceiling 30 in the selected rotational orientation depending upon the selected direction of the emitted light and the type and number of reflector modules to be used and whether a houseside shield 138 is to be used. Alternatively, the electrical housing 12 can be attached to the ceiling 30 first, and then the additional parts can be added thereto.

Figure 8:
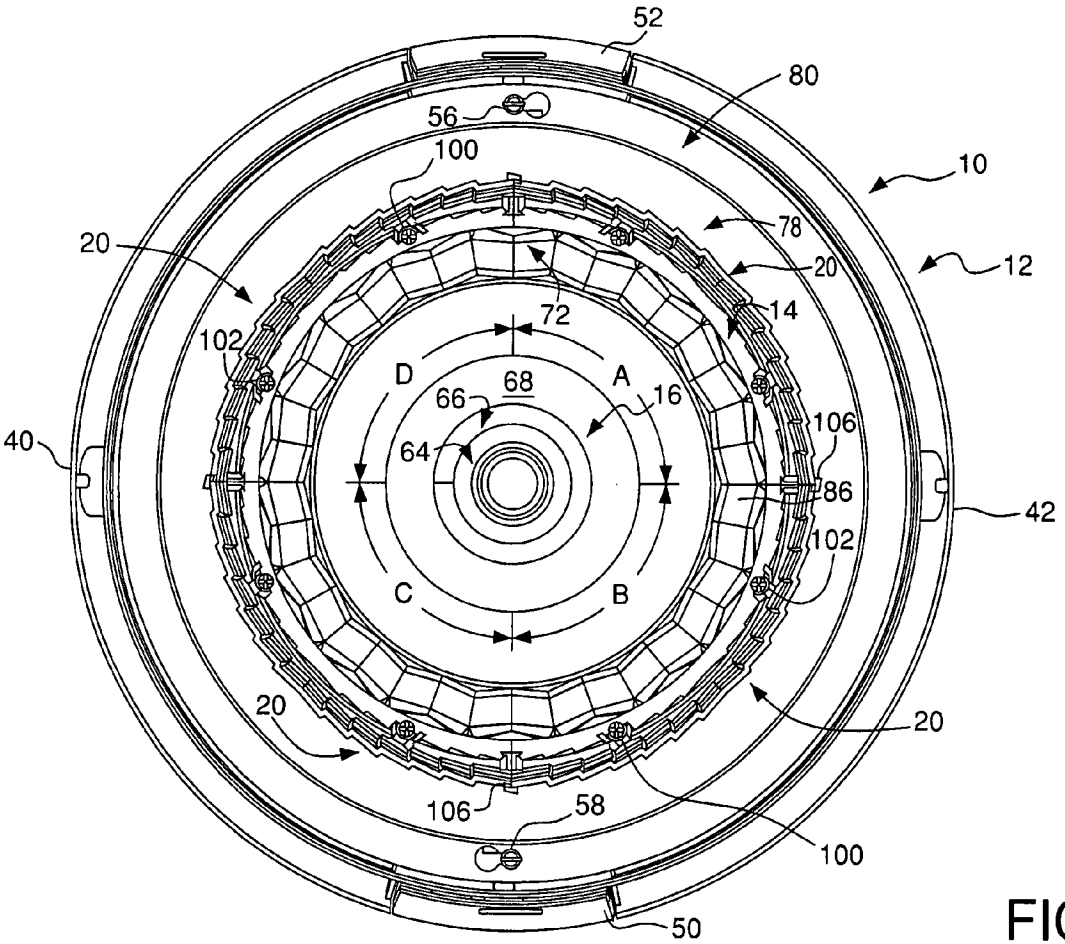
FIG. 8 is a bottom plan view in section taken along line 8-8 in FIG. 7 of the luminaire shown in FIG. 7.

Thus, as seen in FIG. 8, an apertured single curved reflector module 20 can be placed in all four positions, i.e., in each of the four quadrants A, B, C, and D. If appropriate, only two reflector modules 20 can be used, for example in only quadrants B and C, C and D, or A and B, as shown diagrammatically in FIGS. 35, 37, and 40. The solid reflector modules 22 can be used as a substitute for the apertured reflector modules when less up-light is appropriate. As installed as seen in FIG. 7, advantageously the bottoms of the apertured curved reflector modules 20, as well as solid curved reflector modules 22, are substantially received in a horizontal plane passing through the refractor 28 adjacent the bottom of third section 130.

Figure 10:
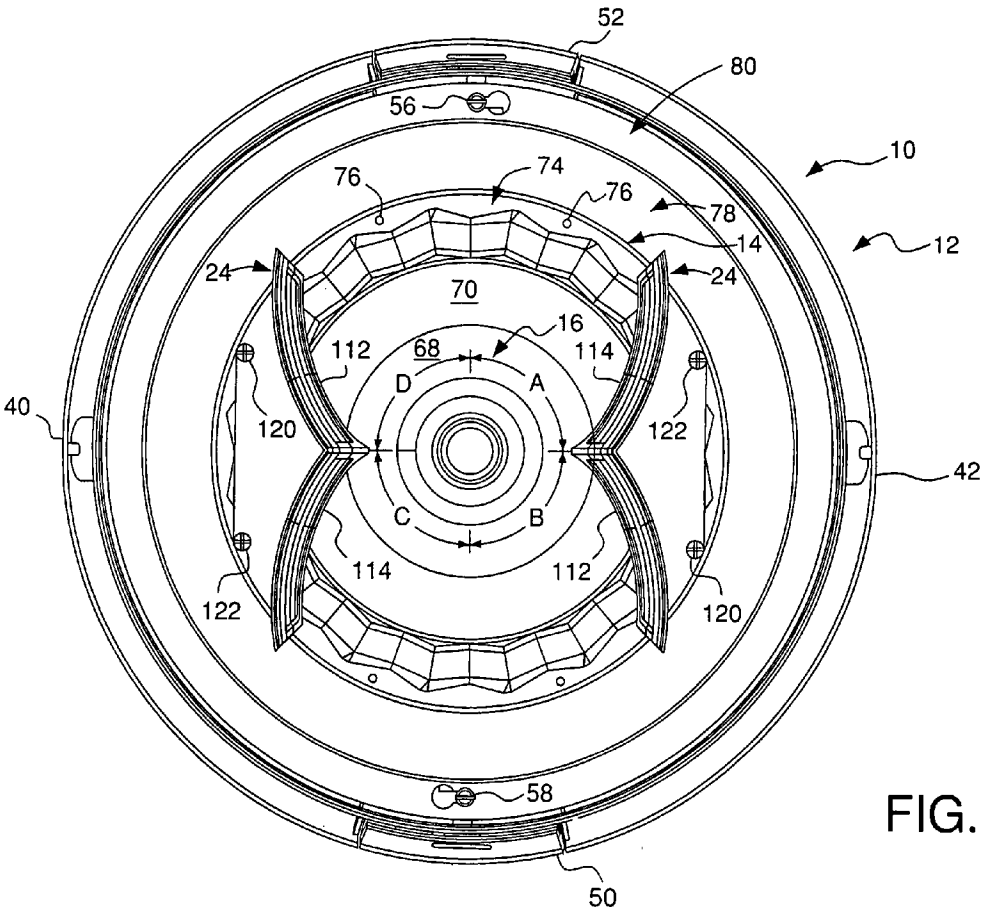
FIG. 10 is a bottom plan view in section taken along line 10-10 in FIG. 9 of the luminaire shown in FIG. 9.

Alternatively, as appropriate and advantageous, two of the apertured double curved reflector modules 24 can be placed opposite one another as seen in FIGS. 9 and 10 so that one of the modules 24 spans quadrants A and B and the other spans quadrants C and D and the two bottoms or linear portions 115 of the gull-wing shapes point towards one another and define and are received in a vertical plane substantially intersecting axis 62. The curved concave surfaces 112 and 114 on the double curved reflector modules have centers of their radii of curvature spaced outwardly from central axis 62. This is diagrammatically shown in FIG. 30. Alternatively, as diagrammatically shown in FIG. 27, the two apertured double curved reflector modules 24 can be positioned spanning quadrants A and D and B and C. The solid double curved reflector modules 26 can be used as a substitute for the apertured reflector modules when less up-light is appropriate. As seen in FIG. 9, advantageously the bottoms of the two apertured double curved reflector modules 24, as well as the solid double curved reflector modules 26, are substantially received in a horizontal plane passing through the refractor 28 adjacent the bottom of third section 130.

Operation of the Luminaire

Once assembled and installed in the pre-selected configuration as discussed above, the luminaire 10 can be electrically energized so that the lamp 18 emits light and the upper reflector 14, selected reflector modules 20, 22, 24, and 26, and refractor 28 can disperse, refract, redirect, and transmit the light to the surrounding three-dimensional space. The light emitted by the luminaire 10 is selectively directed generally upwardly, outwardly, and downwardly depending upon how the luminaire is configured, as best seen in FIGS. 5, 7, 9, and 19, and diagrammatically shown in FIGS. 21-42.

If configured as shown in FIGS. 5-6 with no internal reflector modules, light from lamp 18, for example, can be transmitted generally upwardly out of the refractor 28 via dispersing section 126 and generally downwardly via transparent section 136 as shown by the light beam traces. Light from the lamp 18 is also, for example, incident on frustoconical portions 72 and 78 of the upper reflector 14 and is reflected out of the refractor via transparent section 136 and the horizontal prisms 132, and is reflected off the reflective section 128 on the inside of the refractor and then out of the refractor via prisms 132 as shown by the light beam, or ray, traces in FIG. 5. Of course, these light beam traces are only exemplary, and a multitude of these traces are created by the light and the luminaire 10.

The luminaire 10 as configured as shown in FIGS. 5 and 6 generates upper and lower illumination patterns 150 and 152 as shown diagrammatically in FIGS. 21-23 with the luminaire being referred to as PGL51 therein. The uplight or upper pattern is generally circular, as is the lower or downlight pattern, which is shown in FIGS. 22 and 23 on the floor 32.

If configured as shown in FIGS. 7-8 with four apertured curved reflector modules 20 forming a substantially cylindrical array of reflectors centered on axis 62, light from lamp 18 generally is reflected by the upper reflector 14 and reflected and transmitted by the refractor 28 as in FIGS. 5-6, except that the reflector modules 20 block light from being incident on section 130 and by themselves reflect the light downwardly and outwardly in an opposite direction from the incident light directed thereon as shown by the exemplary light beam traces in FIG. 7. Of course, the apertures 88, 90, and 92 allow light to pass therethrough and help form the uplight illumination.

The luminaire 10 as configured as shown in FIGS. 7-8 generates upper and lower illumination patterns 154 and 156 as shown diagrammatically in FIGS. 24-26 with the luminaire being referred to as PGL52 therein. The upper pattern is generally circular and the lower pattern is generally square.

If the four apertured single curved reflector modules 20 in FIGS. 7-8 are replaced by four solid single curved reflector modules 22, then there would be no appreciable uplight, but the remaining light reflection and transmission is the same in the downward and outward directions.

Figure 34:
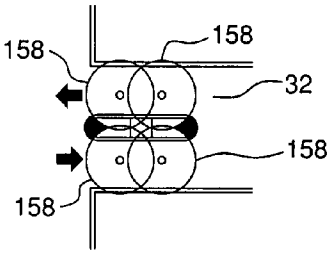
FIG. 34 is a diagrammatic top plan view of the illumination pattern created by four luminaires from FIG. 33.
Figure 33:
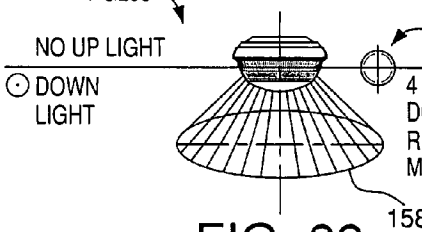
FIG. 33 is a diagrammatic side elevational view of the luminaire and its illumination pattern with the use of four solid curved reflector modules.

The luminaire 10 as configured with four solid single curved reflector modules 22 generates the generally circular lower illumination pattern 158 shown diagrammatically in FIGS. 33-34 with the luminaire being referred to as PGL55 therein.

Figure 36:
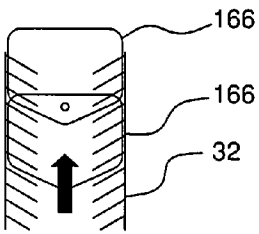
FIG. 36 is a diagrammatic top plan view of the illumination pattern created by two of the luminaires shown in FIG. 35.
Figure 30:
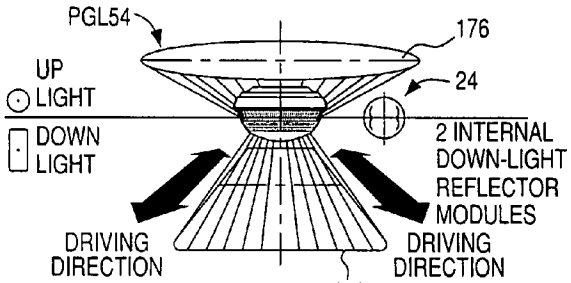
FIG. 30 is a diagrammatic side elevational view of the luminaire and its illumination pattern with the use of two apertured double curved reflector modules oriented parallel to traffic flow.
Figure 39:
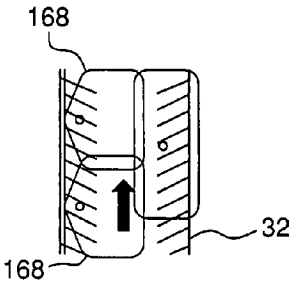
FIG. 39 is a diagrammatic top plan view of the illumination pattern created by three of the luminaires shown in FIG. 37 with a one-way drive lane and a single fixture row.
Figure 38:
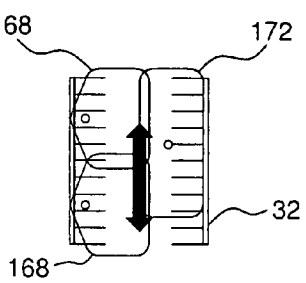
FIG. 38 is a diagrammatic top plan view of the illumination pattern created by three of the luminaires shown in FIG. 37 with a two-way drive lane and double fixture row.
Figure 42:
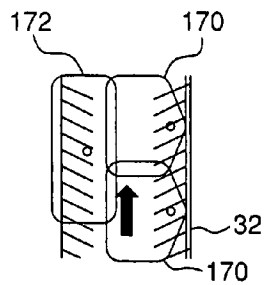
FIG. 42 is a diagrammatic top plan view of the illumination pattern created by three of the luminaires shown in FIG. 40 with a one-way drive land and single fixture row.
Figure 41:
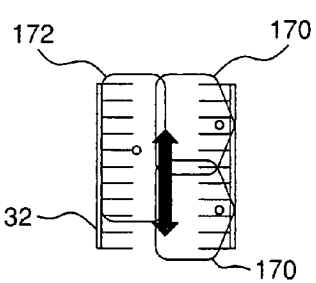
FIG. 41 is a diagrammatic top plan view of the illumination pattern created by three of the luminaires shown in FIG. 40 with a two-way drive lane and double fixture row.

Luminaire 10 can also be configured with only two apertured curved reflector modules 20 in a fashion similar to that shown in FIGS. 7-8 regarding four reflector modules 20. This configuration allows the two reflector modules 20 to be positioned in quadrants B and C as shown in FIGS. 35-36 regarding luminaire 10 referred to as PGL56, in quadrants C and D as shown in FIGS. 37-39 regarding luminaire 10 referred to as PGL57, and in quadrants A and B as shown in FIGS. 40-42 regarding luminaire 10 referred to as PGL58.

As shown in FIGS. 35-42, the upper illumination patterns 160, 162, and 164 are generally circular, while the lower illumination patterns 166, 168, and 170 are generally rectangular with one peaked side.

If the houseside shield 138 is used as optionally shown in FIGS. 37-42, the lower illumination 172 pattern becomes generally rectangular.

The luminaire 10 can also be configured with two apertured double curve reflector modules 24 as shown in FIGS. 9 and 10 with the light emitted by lamp 18 being reflected, refracted, and transmitted by the upper reflector 14, the two reflector modules 24, and the refractor 28 as exemplified by the light beam traces shown in FIG. 9. The upper reflector 14 acts substantially the same as in FIG. 7, but the two reflector modules 24 allow more uplight and provide substantially rectangular downlight, as seen diagrammatically in FIGS. 27-32.

The two reflector modules 24 shown in FIGS. 9-10 respectively span quadrants A and B and C and D, although they could be relocated by 90° as seen in FIG. 27.

If the solid double curved reflector modules 26 are used as a substitute for the apertured double curved reflector modules, then less uplight will be emitted from the luminaire.

Luminaire 10 configured with the two apertured double curved reflector modules 26 are designated PGL53 and PGL54 as diagrammatically illustrated in FIGS. 27-32. Each luminaire creates a generally circular upper illumination pattern 174 and 176, and a generally rectangular lower illumination pattern 178 and 180, respectively.

While advantageous embodiments have been chosen to illustrate the invention, it will be understood by those skilled in the art that various changes and modifications can be made therein without departing from the scope of the invention as defined in the appended claims.

What is claimed is:

1. A luminaire capable of selectively directing light from a lamp therein generally upwardly, downwardly, and outwardly, the combination comprising:

an electrical housing having a generally downwardly directed socket adapted to receive and support a generally vertically oriented lamp, and having a plurality of coupling members positioned around said socket;

an upper reflector, coupled to said housing, and having at least a first portion located to reflect light from a lamp received in said socket;

at least one reflector module selected from a group comprising a first reflector having a first configuration, and a second reflector having a second configuration different from said first configuration;

at least one fastener for coupling said at least one reflector module to at least one of said plurality of coupling members supported by said housing in a selected location to reflect light directly emitted from the lamp in a selected direction; and a refractor coupled to and extending downwardly from said housing, substantially enclosing said socket, upper reflector, and reflector module, and transmitting light from the lamp to the outside of the luminaire.

2. A luminaire according to claim 1, wherein said upper reflector has a second portion positioned around said socket.

3. A luminaire according to claim 2, wherein said upper reflector second portion is substantially frustoconical and extends downwardly and outwardly relative to said socket.

4. A luminaire according to claim 3, wherein said upper reflector has a third portion positioned around said socket, having a substantially frustoconical shape, and extending upwardly and outwardly relative to said socket.

5. A luminaire according to claim 1, wherein said plurality of coupling members are located on said upper reflector.

6. A luminaire according to claim 1, wherein said upper reflector has a substantially downwardly facing, substantially annular portion having said plurality of coupling members located thereon.

7. A luminaire according to claim 1, wherein said at least one reflector module comprises at least two reflector modules.

8. A luminaire according to claim 1, wherein said at least one reflector module comprises four reflector modules.

9. A luminaire according to claim 1, wherein said at least one reflector module is curved.

10. A luminaire according to claim 1, wherein said at least one reflector module is curved, the curvature thereof preventing any reflective light from intersecting the lamp.

11. A luminaire according to claim 1, wherein said at least one reflector module has substantially one curved surface thereon.

12. A luminaire according to claim 1, wherein said at least one reflector module has substantially two curved surfaces thereon.

13. A luminaire according to claim 12, wherein said two curved surfaces are in a substantially gull-wing configuration.

14. A luminaire according to claim 1, wherein said refractor has a section that reflects light back inside said refractor and includes a series of substantially vertically oriented prisms.

15. A luminaire according to claim 1, wherein said refractor has a section that allows light to pass therethrough and to be refracted downwardly and includes a series of substantially horizontally oriented prisms.

16. A luminaire according to claim 1, wherein said refractor has a first section that allows light to pass therethrough, a second section that reflects light back inside said refractor, a third section that allows light to pass therethrough and to be refracted downwardly, and a fourth substantially transparent section that allows light to pass therethrough.

17. A luminaire according to claim 1, wherein said refractor has a first section that allows light to pass therethrough and includes a series of substantially vertically oriented prisms.

18. A luminaire capable of selectively directing light from a lamp therein generally upwardly, downwardly, and outwardly, the combination comprising:

an electrical housing having a generally downwardly directed socket adapted to receive and support a generally vertically oriented lamp, and having a plurality of coupling members positioned around said socket;

an upper reflector, coupled to said housing, and having at least a first portion located to reflect light from a lamp received in said socket;

at least one reflector module;

at least one fastener for coupling said at least one reflector module to at least one of said plurality of coupling members supported by said housing in a selected location to reflect light emitted from the lamp in a selected direction; and a refractor coupled to and extending downwardly from said housing, substantially enclosing said socket, upper reflector, and reflector module, and transmitting light from the lamp to the outside of the luminaire, said at least one reflector module having at least one aperture therein to allow light to pass therethrough.

19. A luminaire capable of selectively directing light from a lamp therein generally upwardly, downwardly, and outwardly, the combination comprising:

an electrical housing having a generally downwardly directed socket adapted to receive and support a generally vertically oriented lamp, and having a plurality of coupling members positioned around said socket;

an upper reflector, coupled to said housing, and having at least a first portion located to reflect light from a lamp received in said socket;

at least one reflector module;

at least one fastener for coupling said at least one reflector module to at least one of said plurality of coupling members supported by said housing in a selected location to reflect light emitted from the lamp in a selected direction; and a refractor coupled to and extending downwardly from said housing, substantially enclosing said socket, upper reflector, and reflector module, and transmitting light from the lamp to the outside of the luminaire, said at least one reflector module having at least two apertures therein to allow light to pass therethrough.

20. A luminaire according to claim 1, wherein said refractor has a substantially transparent, inverted dome-shaped section at the bottom thereof that allows light to pass therethrough.

21. A luminaire according to claim 1, wherein said refractor has a section on the interior thereof that spreads light from the lamp substantially horizontally and that comprises a series of substantially vertically oriented prisms.

22. A luminaire according to claim 1, wherein said coupling members comprise a series of threaded bores formed in said upper reflector, and said at least one fastener comprises a threaded fastener threadedly coupled to one of said series of threaded bores.

23. A luminaire, the combination comprising:

an electrical housing having a generally downwardly directed socket adapted to receive and support a generally vertically oriented lamp;

an upper reflector, coupled to said housing, and having at least a first portion located above the bottom of said socket, a substantially frustoconical second portion extending downwardly and outwardly relative to said socket and located substantially around the sides of said socket, and a substantially annular portion having a plurality of coupling members thereon; and a refractor coupled to and extending downwardly from said housing, substantially enclosing said socket, and upper reflector, and transmitting light from the lamp to the outside of the luminaire;

said refractor having a substantially hemispherical shape and including a first section that allows light to pass therethrough, a second section that reflects light back inside said refractor, a third section that allows light to pass therethrough and to be refracted downwardly, and a fourth substantially transparent section that allows light to pass therethrough.

24. A luminaire according to claim 23, wherein said reflector second portion extends downwardly and outwardly relative to said socket at about 66° to a plane substantially perpendicular to said socket.

25. A luminaire according to claim 24, wherein said reflector has a third portion positioned around said socket, having a substantially frustoconical shape, and extending upwardly and outwardly relative to said socket.

26. A luminaire according to claim 23, wherein said annular portion is substantially downwardly facing.

27. A luminaire according to claim 23, wherein
said first section is located above said second section.

28. A luminaire according to claim 23, wherein
said first section includes a series of substantially vertically oriented prisms.

29. A luminaire according to claim 23, wherein
said second section includes a series of substantially vertically oriented prisms.

30. A luminaire according to claim 23, wherein
said third section includes a series of substantially horizontally oriented prisms.

31. A luminaire according to claim 23, wherein
said fourth section has a substantially inverted dome-shape.

32. A luminaire according to claim 23, wherein
said refractor has a section on the interior thereof that spreads light from the lamp substantially horizontally and that comprises a series of substantially vertically oriented prisms.

33. A luminaire capable of selectively directing light from a lamp therein generally upwardly, downwardly, and outwardly, the combination comprising:
an electrical housing having a generally downwardly directed socket adapted to receive and support a generally vertically oriented lamp, and having a plurality of coupling members positioned around said socket;
an upper reflector, coupled to said housing, and having at least a first portion located to reflect light from a lamp received in said socket;
at least one reflector module comprising a solid single curved reflector, an apertured single curved reflector, a solid double curved reflector, or an apertured double curved reflector;
at least one fastener for coupling said at least one reflector module to at least one of said plurality of coupling members supported by said housing in a selected location to reflect light emitted from the lamp in a selected direction; and
a refractor coupled to and extending downwardly from said housing, substantially enclosing said socket, upper reflector, and reflector module, and transmitting light from the lamp to the outside of the luminaire.

34. A luminaire according to claim 33, wherein
said solid and apertured single curved reflectors are each generally in the shape in plan view of an arc of a circle extending through about 90°.

35. A luminaire according to claim 33, wherein
said solid and apertured double curved reflectors are each generally in a gull-wing shape in plan view.

36. A luminaire according to claim 33, and further comprising
a shield supported above said refractor for blocking a portion of the light emanating from the lamp from directly being emitted from the luminaire.

37. A luminaire according to claim 36, wherein
said shield is coupled to at least one of said reflector modules.

38. A luminaire according to claim 33, wherein
said at least one reflector module comprises two curved reflector modules, the curvature of each of said two curved reflector modules thereof being substantially uniform.

39. A luminaire according to claim 33, wherein
said at least one reflector module has a radius of curvature substantially coincident with a central vertical axis passing through said socket.

40. A luminaire according to claim 33, wherein
said at least one reflector module comprises a pair of substantially gull-winged shaped reflector modules, each of said gull-wing shaped reflector modules having a substantially linear portion in the middle thereof and two curved portions on opposite sides of said linear portion.

41. A luminaire according to claim 40, wherein
said gull-wing shaped reflector modules linear portions are located in a substantially vertical plane substantially intersecting said central vertical axis.

42. A luminaire according to claim 40, wherein
the centers of the radii of curvature of said curved portions in each of said gull-wing shaped reflector modules are spaced from said central vertical axis.

43. A luminaire capable of selectively directing light from a lamp therein generally upwardly, downwardly, and outwardly, the combination comprising:
an electrical housing having a generally downwardly directed socket adapted to receive and support a generally vertically oriented lamp, and having a plurality of coupling members positioned around said socket;
an upper reflector, coupled to said housing, and having at least a first portion located to reflect light from a lamp received in said socket;
at least one reflector module;
at least one fastener for coupling said at least one reflector module to at least one of said plurality of coupling members supported by said housing in a selected location to reflect light emitted from the lamp in a selected direction; and
a refractor coupled to and extending downwardly from said housing, substantially enclosing said socket, upper reflector, and reflector module, and transmitting light from the lamp to the outside of the luminaire;
said at least one reflector module having two curved surfaces thereon forming a substantially gull-wing configuration.

44. A luminaire capable of selectively directing light from a lamp therein generally upwardly, downwardly, and outwardly, the combination comprising:
an electrical housing having a generally downwardly directed socket adapted to receive and support a generally vertically oriented lamp, and having a plurality of coupling members positioned around said socket;
an upper reflector, coupled to said housing, and having at least a first portion located to reflect light from a lamp received in said socket;
at least one reflector module;
at least one fastener for coupling said at least one reflector module to at least one of said plurality of coupling members supported by said housing in a selected location to reflect light emitted from the lamp in a selected direction; and
a refractor coupled to and extending downwardly from said housing, substantially enclosing said socket, upper reflector, and reflector module, and transmitting light from the lamp to the outside of the luminaire;
said at least one reflector module being coupled to at least one of said plurality of coupling members only at the top of said at least one reflector module, the bottom of said at least one reflector module being uncoupled to said electrical housing.

45. A luminaire, the combination comprising:
an electrical housing having a generally downwardly directed socket adapted to receive and support a generally vertically oriented lamp;

an upper reflector, coupled to said housing, and having at least a first portion located above the bottom of said socket, a substantially frustoconical second portion extending downwardly and outwardly relative to said socket and located substantially around the sides of said socket, and a substantially annular portion having a plurality of coupling members thereon;

at least one reflector module fastened to at least one of said plurality of coupling members;

a refractor coupled to and extending downwardly from said housing, substantially enclosing said socket, said reflector module, and said upper reflector, and transmitting light from the lamp to the outside of the luminaire, said refractor having a first section that allows light to pass therethrough in a direction substantially transverse to said lamp, a second section that allows light to pass therethrough and to be refracted downwardly, and a third substantially transparent section that allows light to pass therethrough in a generally downward direction.

* * * * *